United States Patent [19]

Hoehn et al.

[11] Patent Number: 4,713,961

[45] Date of Patent: Dec. 22, 1987

[54] TRANSFER PRESS

[75] Inventors: Herbert Hoehn, Goeppingen; Kurt Strommer, Kuchen, both of Fed. Rep. of Germany

[73] Assignee: L. Schuler GmbH, Goeppingen, Fed. Rep. of Germany

[21] Appl. No.: 828,183

[22] Filed: Feb. 11, 1986

[30] Foreign Application Priority Data

Feb. 13, 1985 [DE] Fed. Rep. of Germany ..... 3504765

[51] Int. Cl.[4] ..... B21D 43/20

[52] U.S. Cl. ..... 72/419; 72/405; 108/140; 100/207

[58] Field of Search ..... 72/405, 419, 421, 422; 248/651, 298; 108/140, 136, 94, 150, 102, 103; 100/207

[56] References Cited

U.S. PATENT DOCUMENTS

| | | | |
|---|---|---|---|
| 1,523,063 | 1/1925 | Fuchs | 414/751 |
| 1,744,666 | 1/1930 | Newsom | 108/102 |
| 2,118,620 | 5/1938 | Orsenigo | 108/103 |
| 3,456,814 | 7/1969 | Bautz . | |
| 4,503,766 | 3/1985 | Hacker et al. | 72/405 |
| 4,540,087 | 9/1985 | Mizumoto | 72/405 |

FOREIGN PATENT DOCUMENTS

| | | | |
|---|---|---|---|
| 2455931 | 1/1981 | France | 72/405 |
| 573323 | 9/1977 | U.S.S.R. | 414/751 |

*Primary Examiner*—Daniel C. Crane

*Attorney, Agent, or Firm*—Barnes & Thornburg

[57] ABSTRACT

Workpieces are stored in idling stages of transfer presses. The support elements (14) which are to be interchanged with the work tool change are to be rotated for bridging a larger idling stage area when brought into the idling stage in the transport direction of the workpieces. Toothed racks (7) which are movable in the direction of the support elements (14) brought-in with the sliding table into the transfer press are attached for that purpose at a gripping and holding mechanism. The toothed racks (7) are adapted to be connected with a traverse (13) carrying the support elements, whereby the support elements (14) are supported at the traverse (13) by way of mounting means (15), to which a rotary movement is adapted to be imparted and which are operatively connected with a rotary drive.

18 Claims, 3 Drawing Figures

TRANSFER PRESS

The present invention relates to an installation for the intermediate storage of workpieces in idling stages of transfer presses, with gripping and retaining mechanisms arranged within the area of idling stages for support elements detachably attached at sliding tables or at work tools carried by the same and to be brought into the area of the nearest idling stage.

In gang presses, transfer presses, gang presses for large parts and similar presses, in which large workpieces are worked in successively arranged stages, so-called idling stages are present between the press columns or supports in which no deformation takes place. As a consequence of the determined transfer movement for the workpieces, the idling stage must include an intermediate storing means which corresponds to the shape of the bottom side of the workpieces to be supported within the support area. With each work tool change, intermediate storing means matched to the new workpiece must be installed.

An installation for the intermediate storage of workpieces in idling stages of transfer presses is disclosed and described in the DE-PS No. 33 34 021. The installation consists of a gripping and holding mechanism arranged within the area of an idling stage. With the aid of toothed racks attached at the gripping and holding mechanism, movable in the transfer direction and constructed as grippers, support elements adapted to be displaced together with the sliding table can be seized and transferred into the area of the idling stage. The position of the support elements in the idling stage, support position, in relation to the transport direction of the workpieces, corresponds to the position of the support elements at the sliding table, respectively, at the work tool. Thus, an intermediate storage for only one workpiece can be installed. The area of the intermediate space between the press columns or supports of the press and the area of a waste bin cannot be bridged. The idling stage must not exceed a width predetermined by the transfer movement.

It is the object of the present invention to so further develop the installation for the intermediate storage of workpieces in idling stages that the support elements are rotated in the direction of the transport of the workpieces when the support elements are brought in, in order to thus bridge a larger idling stage area.

The underlying problems are solved in accordance with the present invention in that mounting means adapted to be imparted with rotary movement are coordinated to each gripping and retaining mechanism which, on the one hand, are adapted to be operatively connected with one support element each and, on the other, are operatively connected with a rotary drive.

Advantages of the present invention reside, inter alia, in that existing installations can be refitted for the intermediate storage, in that the installation is independent of workpiece and serves for the automation of the press because the installation is absolutely reliable in functioning. The rotation of the support elements can take place automatically without an additional adjusting means. For another, for example, shorter transfer movement, intermediate storages disposed one behind the other in the transport direction of the workpieces for two workpieces can be installed with the same number of support elements.

These and other objects, features and advantages of the present invention will become more apparent from the following description when taken in connection with the accompanying drawing which shows, for purposes of illustration only, one embodiment in accordance with the present invention, and wherein.

Figure 1:
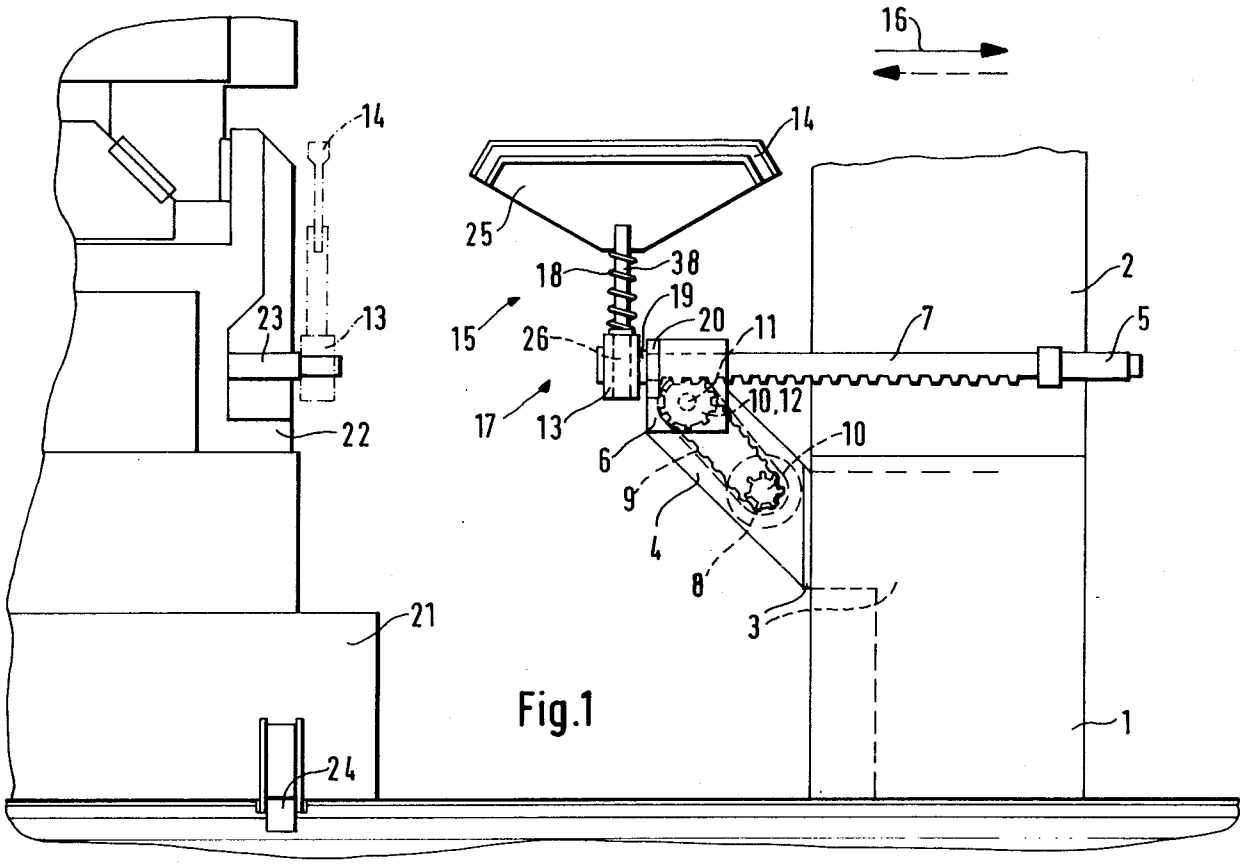
FIG. 1 is a front elevational view of an installation for an intermediate storage in accordance with the present invention.

Referring now to the drawing wherein like reference numerals are used throughout the various views to designate like parts, the idling stage of a press is illustrated by a waste bin 1 within the area of press columns or press supports 2. A bracket with support arms 4 for the support of two toothed racks 7 aligned in the transport direction of the workpieces—arrow 16—is located within the area of the idling stage. The support of the toothed racks 7 takes place in support bearings 6. An adjusting motor 8 is secured on the press, possibly at the bracket 3, which rotates a shaft 11 by way of drive pulleys 10 and drive belts 9. The shaft 11 is supported in both support arms 4 and includes gears 12 which engage in a similar toothed arrangement at the bottom side of the toothed racks 7. The support arms 4 are additionally rigidly connected with each other by an abutment bar 20. The end parts 17 of the toothed racks 7 area, as will be described more fully hereinafter by reference to FIG. 3, constructed for mounting thereon a traverse 13 detachably supported by way of mounting devices 23 at a sliding table 21, or possibly at a work tool 22 supported by the sliding table 21. The sliding table 21 is interchangeable by way of roller means 24 or the like. The traverse 13 is shown in full lines at the toothed racks 7 and in dash and dotted lines at the work tool 22. The traverse 13 carries for each support element 14 a mounting bolt 38 in a rotary bearing 26. A support 25 matched to the shape of the support element 14 is attached in the upper end area of the mounting bolt 38. A torsion spring 18 is clamped in between the upper area of the mounting bolt 38 and the traverse 13. Mounting bolt 38, support 25 and torsion spring 18 form the mounting means generally designated by reference numeral 15 to which a rotary movement is adapted to be imparted.

Figure 2:
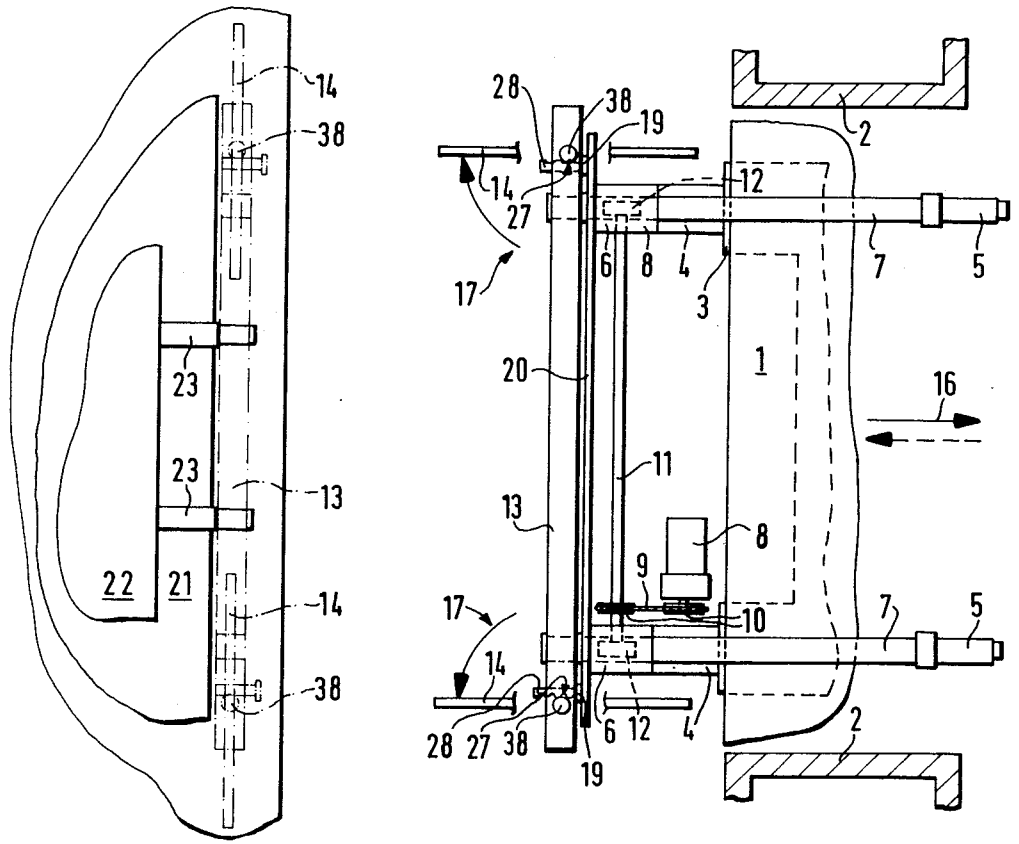
FIG. 2 is a plan view on the installation shown in FIG. 1.

As can be seen from FIG. 2, toothed racks 28 which are loosely inserted in the traverse 13 within the rotary area of the mounting bolts 38, extend in the transport direction 16 and cooperate with teeth 27 at the mounting bolts 38. The toothed racks 28 are placed against the abutment bar 20 by way of rotary extensions, abutments 19.

During the return movement of the traverse 13 for the storage in the mounting devices 23 at the work tool 22 or at the sliding table 21, the energy which was stored in the torsion spring 18 during the movements of the traverse 13 into the idling stage, is released, as a result of which the mounting bolt 38 together with the support 25 and the support element 14 adjusts itself in such a manner that the support element 14 is aligned in a direction disposed transversely to the transport direction 16 of the workpieces. The toothed racks 28 move toward the right in relation to the traverse 13. After the work tool change when a newly equipped sliding table 21 is brought-in with toothed racks 7, at least slight retracted from the traverse 13, the support elements coordinated in this case to the work took 22 are seized by way of the traverse 13 by the toothed racks 7 constructed in their end areas 17 as gripper elements and are moved into the idling stage. Prior to reaching the support position, the toothed racks 28 come into abutment at the abutment bar 20 by way of the abutments 19 so that the toothed racks 28 move toward the left in relation to the traverse 13, the support elements are rotated by reason of the toothed arrangements 27 and the torsion springs 18 are stressed.

Figure 3:
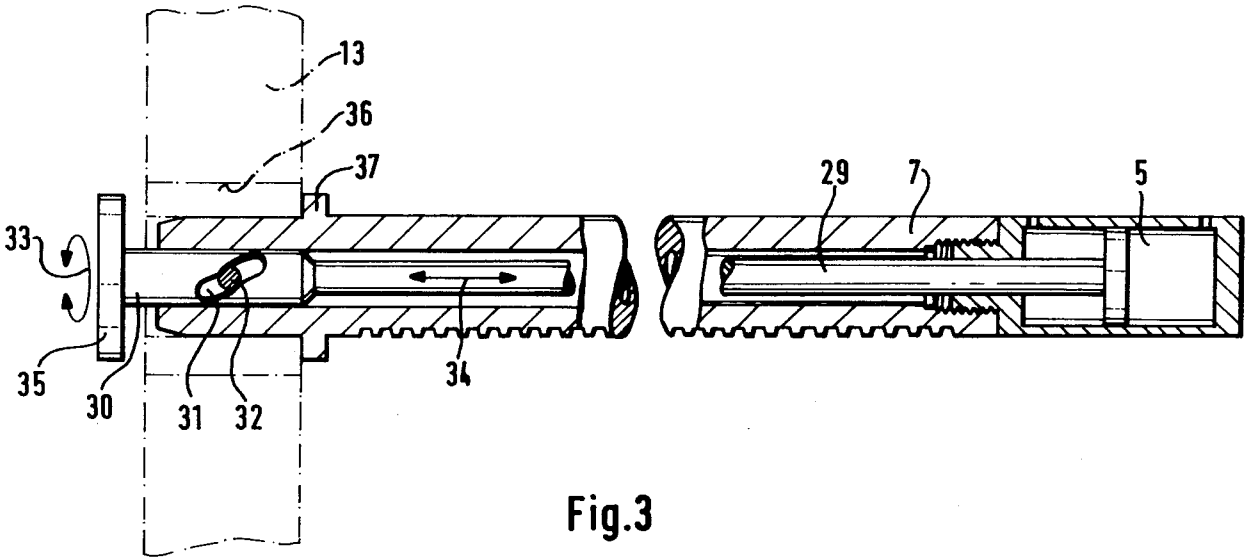
FIG. 3 is a cross-sectional view through the adjustment drive for fixing the traverse at the toothed racks.

For the secure retention of the traverse 13 at each toothed rack 7, the latter includes corresponding to FIG. 3, for example, a centrally located displacement rod 29 which is securely connected with the piston of a working cylinder 5 adapted to be acted upon by a pressure medium. The other end part of the displacement rod 29 which is thus displaceable in the direction of the double arrow 34, is connected with a bolt 30. The bolt 30 is rotatably supported on the displacement rod 29 and includes a thread-like circumferential groove 31 in which a pin 32 is guided. The pin 32 is fixed in the toothed rack 7. The end of the bolt 30 which protrudes out of the toothed rack 7 carries a latch 35 which, as a result of the effected rotation of the bolt 30, is adapted to be fixed behind an aperture 36 in the traverse 13. The double arrow 33 points out the rotary movement of the latch 35 for fixing the traverse 13 at the flange extension 37 at the toothed rack 7 and for the disengagement therefrom.

It is within the scope of the present invention to arrange the traverse 13 fixedly at the toothed racks 7 or to provide the toothed racks 7 with the mounting means 15 adapted to be set into rotary movement, whereby the rotary drive thereof can also take place by way of a controllable adjusting drive. The support position of the support elements 14 may also be different, for example, may be located centrally with respect to the press columns or supports 2. For the embodiment illustrated in FIG. 1, the bracket 3 is to be equipped for the mounting of two further toothed racks 7 to be arranged to the right in FIG. 1, as gripper elements for the transfer at a second sliding table or at a support elements supported at the work tool thereof.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. An installation for transferring workpieces from a moveable work station means to a plurality of different idle areas, each associated with a press installation whereat the workpiece can be stored, comprising: a plurality of press installations each having an idle area adjacent thereto; each press installation including a movable work station means moveable between idle areas; gripping and retaining means arranged at each idle area for gripping and retaining supporting element means used to hold workpieces; each supporting element means detachably attached to mounting means carried by the moveable work station means to be moved adjacent an area of one of the idling areas by said gripping and retaining means; said mounting means coordinated to each gripping and retaining means; said gripping and retaining means being operable to be set into rotary motion by a rotary drive means; said gripping and retaining means moveable towards said mounting means to detach said supporting element means from said mounting means; said rotary drive means rotating said supporting element means after detachment from said mounting means; and said gripping and retaining means being able to move said supporting element means into the idle area of its associated press installation.

2. An installation according to claim 1, wherein the gripping and retaining means comprises toothed rack means constructed as gripper means; said toothed rack means being displaceably supported for movement toward and away from its associated idle area to move the toothed rack means when the mounting means are arranged in the area of the toothed rack means near the work station means.

3. An installation according to claim 2, wherein the gripping and retaining means is operatively connected with at least one traverse means which carries the supporting element means, said traverse means being detachably secured to the mounting means at the work station means and being operable to be taken along by the toothed rack means; the traverse means including for each supporting element means a rotation mounting means mounting said supporting element means for rotation; and rotation means connected with each rotation mounting means to rotate the rotation mounting means.

4. An installation according to claim 3, wherein there are plural gripping and retaining means, each having support bracket means for supporting the gripping and retaining means adjacent the idle area and wherein the traverse means is operable to be seized by an end part(s) of the toothed rack means, which end part is located near the work station means; gear means rotatably supported on the bracket means and engaging with teeth of a respective toothed rack means; and a common shaft means operatively connecting the gear means of two gripping and retaining means; and wherein said common shaft means is driven by a motor.

5. An installation according to claim 4, wherein the rotating means comprises a mounting bolt having an upper mounting area for the support element and a rotary bearing area for bearing support in the traverse means; and wherein teeth means are provided for each mounting bolt within the rotary bearing area thereof.

6. An installation according to claim 5, wherein the rotating mounting means further comprises loose toothed rack means operatively connected with the teeth means of the mounting bolt; the toothed rack being loosely supported for movement toward and away from the idle area within the traverse means; each loose toothed rack including an abutment directed against the gripping and retaining means and operable to be abutted at an abutment bar of the gripping and retaining means; and each mounting bolt being operatively connected with a force storage means for storing the rotary movement.

7. An installation according to claim 6, wherein each force storage means includes a prestressed torsion spring supported on the mounting bolt which has one end part secured at the traverse means and with another end part secured at the mounting bolt.

8. An installation according to claim 7, further comprises a displacement rod moveable with each toothed rack means; one end part of the displacement rod being connected with a working cylinder for longitudinal movement; said working cylinder being supported within an end area of the toothed rack means remote from the work station means; and another end part of the displacement rod being operatively connected with a rotatable bolt movably supported in the area of the toothed rack means near the work station means, the rotatable bolt having a spirally shaped circumferential groove which cooperates with a pin in the toothed rack means for a rotary movement during its longitudinal movement by way of the displacement rod; and the rotatable bolt including at its end part protruding out of the toothed rack means a latch operable to be securely anchored at the traverse means.

9. An installation according to claim 3, wherein the rotating means comprises a mounting bolt having an upper mounting area for the support element and a rotary bearing area for bearing support in the traverse means; and wherein teeth means are provided for each mounting bolt within the rotary bearing area thereof.

10. An installation according to claim 9, wherein the rotating mounting means further comprises loose toothed rack means operatively connected with the teeth means of the mounting bolt; the toothed rack being loosely supported for movement toward and away from the idle area within the traverse means; each loose toothed rack including an abutment directed against the gripping and retaining means and operable to be abutted at an abutment bar of the gripping and retaining means; and each mounting bolt being operatively connected with a force storage means for storing the rotary movement.

11. An installation according to claim 10, wherein each force storage means includes a prestressed torsion spring supported on the mounting bolt which has one end part secured at the traverse means and with another end part secured at the mounting bolt.

12. An installation according to claim 2, further comprising a displacement rod moveable with each toothed rack means; one end part of the displacement rod being connected with a working cylinder for longitudinal movement; said working cylinder being supported within an end area of the toothed rack means remote from the work station means; and another end part of the displacement rod being operatively connected with a rotatable bolt movable supported in the area of the toothed rack means near the work station means, the rotatable bolt having a spirally shaped circumferential groove which cooperates with a pin in the toothed rack means for a rotary movement during its longitudinal movement by way of the displacement rod; and the rotatable bolt including at its end part protruding out of the toothed rack means a latch operable to be securely anchored at the traverse means.

13. An installation for transferring workpieces from a moveable work station means to a plurality of different idle areas, which associated with a press installation, comprising: a plurality of press installations each having an idle area adjacent thereto; a movable work station means having work support means thereon and moveable between idle areas; gripping and retaining means attached at each idle area; means to translate the gripping and retaining means away from the idle area to the work station means; workpiece supporting elements on each gripping and retaining means to hold workpieces; said gripping and retaining means placing the workpiece supporting elements on the work station supporting means at the end of its translation away from the idle area; the workpiece supporting elements being rotatable from an initial position to a second position to turn the workpieces supported thereon at right angles to the translation direction of the gripping and retaining means; and rotation initiating means to rotate the supporting elements located on the gripping and retaining means.

14. An installation according to claim 13 wherein the translation of the gripping and retaining means causes actuation of the initiating means.

15. An installation according to claim 14, wherein translation of gripping and retaining means causes actuation of the initiating means via a lost motion connection so that only after the gripping and retaining means have been translated to close proximity to the moveable work station means does rotation occur.

16. An installation according to claim 13, wherein the gripping and retaining means can retrieve workpiece supporting elements from the workpiece supporting means on the moveable table to translate the supporting element back to the idle area; and wherein the spring means are connected to the supporting elements to reversely rotate the supporting elements back to their initial position after the gripping and retaining means have detached the supporting elements from the supporting means.

17. An installation according to claim 14, wherein the gripping and retaining means can retrieve workpiece supporting elements from the workpiece supporting means on the moveable table to translate the supporting element back to the idle area; and wherein spring means are connected to the supporting elements to reversely rotate the supporting elements back to their initial position after the gripping and retaining means have detached the supporting elements from the supporting means.

18. An installation according to claim 15, wherein the gripping and retaining means can retrieve workpiece supporting elements from the workpiece supporting means on the moveable table to translate the supporting element back to the idle area; and wherein spring means are connected to the supporting elements to reversely rotate the supporting elements back to their initial position after the gripping and retaining means have detached the supporting elements from the supporting means.

* * * * *